United States Patent [19]

Wilnau

[11] Patent Number: 4,646,496

[45] Date of Patent: Mar. 3, 1987

[54] STRUCTURAL WALL AND CONCRETE FORM SYSTEM

[76] Inventor: John A. Wilnau, P.O. Box 13529, Orlando, Fla. 32859

[21] Appl. No.: 714,555

[22] Filed: Mar. 21, 1985

[51] Int. Cl.[4] ..... E04B 1/00

[52] U.S. Cl. ..... 52/252; 52/427; 52/724; 52/725; 52/712; 249/219 W; 249/26

[58] Field of Search ..... 52/378, 250, 251, 252, 52/253, 254, 256, 257, 258, 259, 260, 424, 425, 427, 428, 743, 741, 712–714, 724, 725; 249/13, 18, 26, 27, 40, 41, 188, 207, 210, 190, 213, 214, 216, 219 R, 219 W

[56] References Cited

U.S. PATENT DOCUMENTS

| | | | |
|---|---|---|---|
| 1,577,429 | 3/1926 | Wells | 249/26 X |
| 1,630,794 | 5/1927 | Keller | 249/27 X |
| 2,212,906 | 8/1940 | Vokes | 52/427 |
| 2,689,101 | 9/1954 | Dygert | 249/219 W |
| 3,188,696 | 6/1965 | Earhart | 52/712 X |
| 3,226,781 | 1/1966 | Schnabel | 52/712 X |
| 3,426,992 | 2/1969 | Buyken | 249/219 W |
| 3,662,985 | 5/1972 | Parker | 249/219 R |
| 4,363,200 | 12/1982 | Goldenberg | 52/741 X |
| 4,409,764 | 10/1983 | Wilnau | 52/252 X |

FOREIGN PATENT DOCUMENTS

| | | | |
|---|---|---|---|
| 165171 | 6/1949 | Austria | 52/252 |
| 181406 | 8/1954 | Austria | 52/427 |
| 2349865 | 4/1975 | Fed. Rep. of Germany | 52/743 |
| 1066699 | 6/1954 | France | 52/258 |
| 359944 | 7/1938 | Italy | 52/427 |
| 1443278 | 7/1976 | United Kingdom | 249/219 W |

*Primary Examiner*—William F. Pate, III
*Assistant Examiner*—R. Chilcot
*Attorney, Agent, or Firm*—William M. Hobby, III

[57] ABSTRACT

A combined structural wall and concrete form system, and form bracket apparatus are provided in which a wall frame acts as the side walls of a poured concrete form, while supporting the form in place. A plurality of brackets are transversely attached to the wall frame adjacent the position of the column form to support form ties for locking the remaining form walls in place to complete a concrete column form and structural wall combination. The header of the wall frame portion acts as the bottom wall of a concrete beam form, while the same brackets as used for the column form can be attached along the top portion of the wall frame for locking beam forms and form ties in place to support the side walls of the concrete beam form. A top bracket formed with angle iron and straps supports the top portion of the side walls of the beam form. The form support brackets are elongated flat metal members of predetermined length having a plurality of slots therein for driving nails and having alignment notches positioned therein, along with upright form support end portions having an angled edge for driving form ties in place. The brackets are adapted for supporting the form ties for both the columns and beams when used in connection with the wall frame.

9 Claims, 7 Drawing Figures

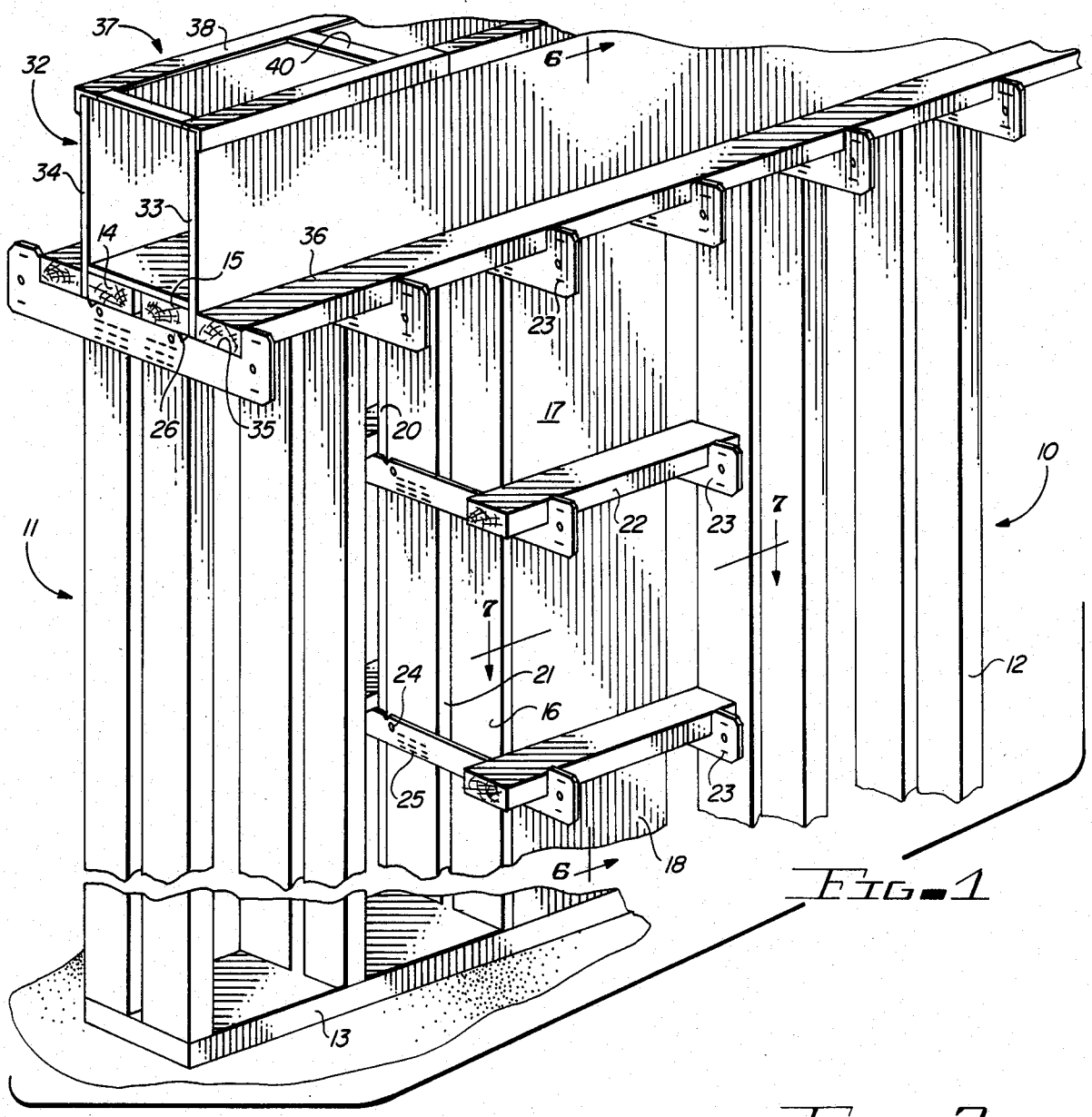
FIG-1
FIG-2
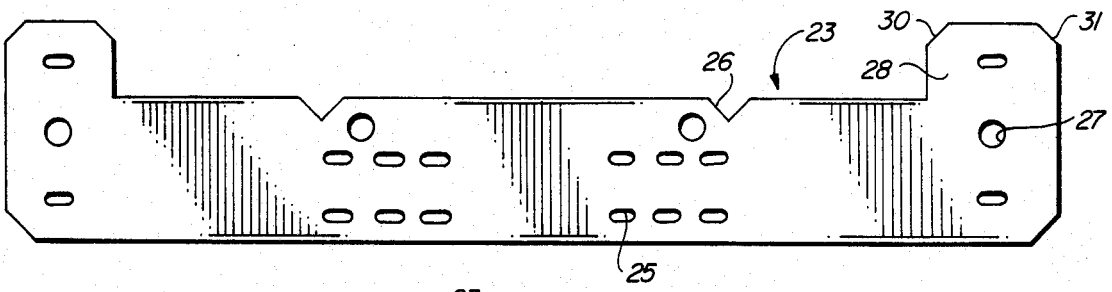
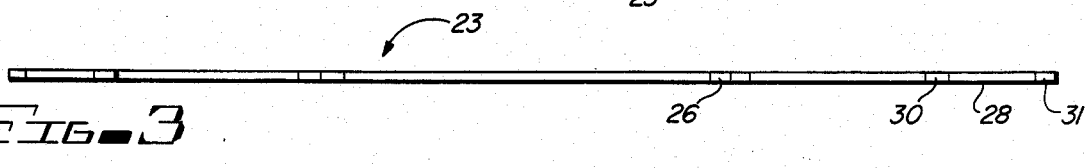
FIG-3
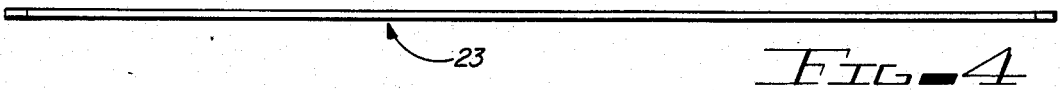
FIG-4

STRUCTURAL WALL AND CONCRETE FORM SYSTEM

BACKGROUND OF THE INVENTION

The present invention relates to a combined structural wall and concrete form system and to a concrete form bracket for locking form walls in place and especially to a structural wall system in which the wall frame members make up some of the wall sides for the column and beam forms while providing structural support for the forms during a concrete pour.

In the past, it has been common to use a wide variety of prefabricated wall systems, as well as specially designed forms for pouring concrete walls, concrete beams and concrete columns. A typical system for reinforced concrete construction can be seen in my prior U.S. Pat. No.: 4,409,764 of Oct. 18, 1983 for a SYSTEM AND METHOD FOR REINFORCED CONCRETE CONSTRUCTION. This prior system was for constructing a structural framework of a building of reinforced concrete using column and beam forms of sheet metal so that a beam and a series of columns could be poured simultaneously. Other Building Systems may be seen in my prior U.S. Patent applications Ser. No.: 514,655 of July 18, 1983 for ROOFING METHOD AND APPARATUS; U.S. Patent application Ser. No.: 649,510 of Sept. 11, 1984 for CONCRETE CONSTRUCTION SYSTEM; and for a PREFABRICATED WALL SECTION, Filed Mar. 18, 1985, Ser. No.: 06/713,323.

The present invention, on the other hand, deals with a wall system in which prefabricated or panelized wall frames are used to construct a building in which portions of the wall frame can be used as supporting walls for columns while the header of the wall frame can be used as the base of a beam form. The remaining walls can be rapidly attached in place by the use of prefabricated brackets which allow the remaining two column form walls to be put in place and locked with ties supported against the brackets. Similarly, the beam form can be rapidly assembled using the header of the wall frame and the same brackets positioned along the top of the wall frame for supporting the base of the sides of the beam form while a special upper bracket can be quickly put in place and the beam and columns poured. When the forms are removed electrical and mechanical components can be placed in the wall along with insulation and the interior and exterior panels placed over the walls to form a complete building section.

SUMMARY OF THE INVENTION

The present invention relates to a structural wall and concrete form system having a prefabricated or panelized wall frame which includes a plurality of upright spaced studs attached to a sole plate on one end and to a header on the other. The sole plate may also be used as the a base wall of a concrete column form and one end of two separate wall frame sections are spaced to make up a pair of column form side walls so that the wall frame not only makes three walls of the column form, but simultaneously provides the support for the form during the concrete pour. The header for the wall frame is used as the base of a concrete beam form so that part of the form for both columns and beams are installed with the wall and supported by the wall frame. Specially fabricated brackets are attached transversely to the wall frame and aligned to support ties for locking to additional column form walls to thereby form a complete column form at each column position. The same prefabricated brackets are attached to the stud adjacent the wall frame headers for supporting the side walls of the beam form, which can rest on the bracket and be locked in place with the 2×4 ties held in place by the brackets. A second set of brackets may be formed of angle iron members having straps therebetween for supporting the top of the beam form to prevent expansion of the top of the form when the concrete is formed thereinto.

The concrete form bracket includes elongated flat metal members of predetermined length having a plurality of slots therein for driving nails therethrough into the wall frame framing members. The brackets have alignment markers or notches placed thereon for rapid alignment of each bracket and each bracket has a pair of upright form support portions on either end thereof to support 2×4 form ties between the upright form support portions and a form wall. The upright form support portions may be angled for ease in driving the 2×4 ties into place.

BRIEF DESCRIPTION OF THE DRAWINGS

Other objects, features and advantages of the present invention will be apparent from the written description and the drawings, in which:

FIG. 1 is a perspective view of a wall structure system having a wall frame portion in place along with the brackets and beam and column forms;

FIG. 2 is a side elevation of a concrete form bracket in accordance with the present invention;

FIG. 3 is a top elevation of the bracket of FIG. 2;

FIG. 4 is a bottom elevation of the bracket of FIGS. 2 and 3;

DESCRIPTION OF THE PREFERRED EMBODIMENTS

Figure 6:
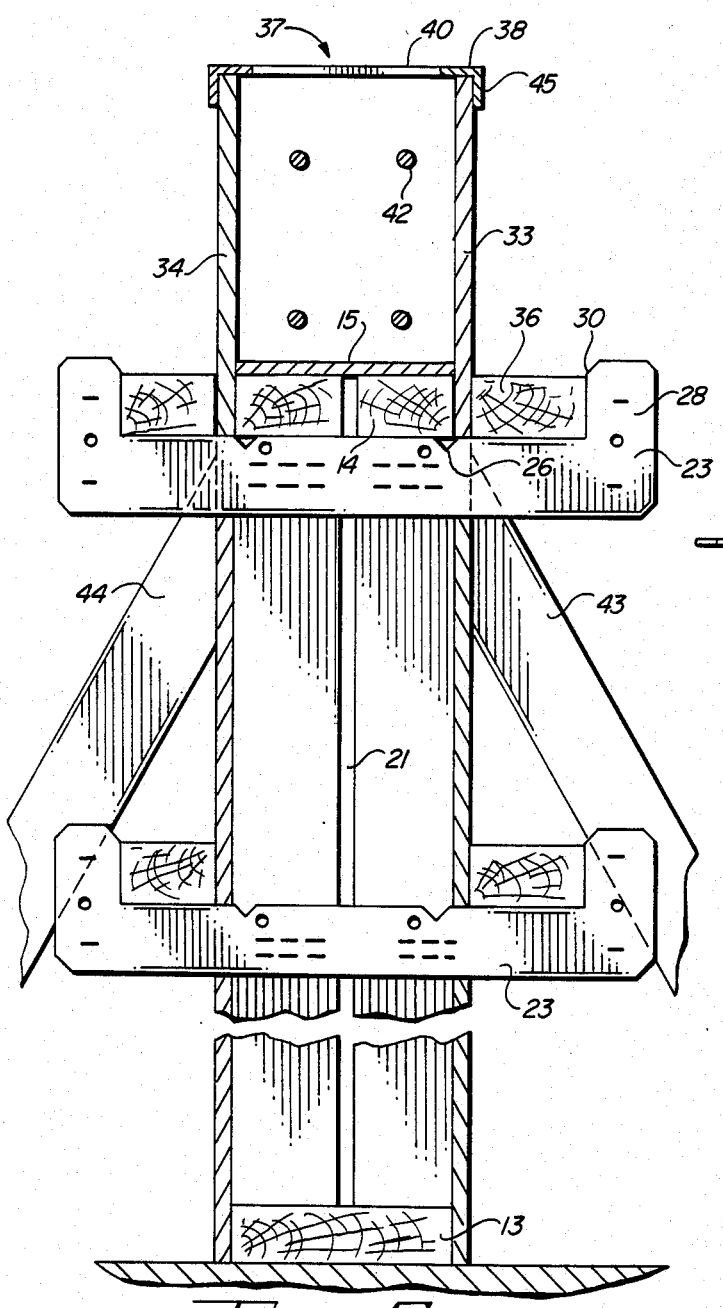
FIG. 6 is a sectional view taken on the line 6—6 of FIG. 1.

Referring to the drawings and especially to FIGS. 1 and 6, wall frames 10 and 11 may be prefabricated or may be moved to a building site in a panelized form ready to be assembled into the wall sections. Each wall section has a plurality of wood or steel framing studs 12 extending in a generally vertical direction along with a sole plate 13 along the bottom thereof and a header 14. The header 14 is made up of a pair of 2×4's having a form board member 15 attached to the top thereof. The wall sections 10 and 11 are spaced a predetermined distance from each other at the ends thereof so that the wall studs 16 of the wall section 11 and the equivalent wall section on the wall frame 10 form two walls of the concrete column pouring form 17. The column form also has a pair of plywood walls 18 and 20 on the other two sides thereof to form a complete concrete form. A thin pressure treated or coated board 21 may be placed inside the stud member 16. The column form walls 18 and 20 are supported in place by a plurality of 2×4 tie members 22 positioned in a plurality of concrete form brackets 23 attached to the frame studs 16 with a plurality of nails 24 through nail slots 25.

The brackets 23, as seen in FIGS. 2 through 4 are formed on an elongated piece of metal and may be stamped out having alignment notches 26, shown aligned in the column form of FIG. 1, along with the slots 25 and a series of apertures 27. The slots 25 allow nails to be driven at an angle therethrough, as well as allow the brackets to be shifted slightly on the nails passing therethrough. Each column and beam form bracket 23 also has a pair of upright form supporting portions 28 which may have dog eared portions 30 and 31, so when placed as shown in FIG. 1, 2×4 ties 22 can be easily knocked in place between the upright portion 28 and the form 18 and is guided by the sloped surfaces 30 on the column and beam form bracket 23. Since the brackets 23 extend all the way across the wall frame portion 16 to support 2×4 ties 22 on either side, the column form walls 18 and 20 are supported between the brackets 23. This produces a very strong column form for pouring the concrete having a large hydrostatic pressure during the pour. Once the concrete pour for the column is completed, the 2×4 ties 22 can be knocked loose and the brackets 23 removed from the framing studs 16.

The wall frames 10 are also formed with a header 14, which may be wood or steel, and has a connecting bottom form portion 15 so that the wall frame 10 also forms one wall of the beam form 32. The beam form 32 has a pair of side walls 33 and 34 resting on the top edge 35 of the brackets 23 and lodged against the header member 14 on one side and by the 2×4 tie members 36 on the other side which are in turn locked in the brackets 23. This firmly locks the bottom of the beam forms 32 against the bottom plate 15 and supports it against expansion. Concrete forms are typically made of plywood and are removed after the forms are poured. But, as can be seen in the present case, the base of the beam form 15 will be left in place and is therefore made of a material that will not be damaged by the concrete moisture. Typical material for this may be a paperboard material which is coated on both sides with an aluminum foil and commonly used as sheathing and insulation in construction. A plurality of top beam form support brackets 37 are made up of angle iron members 38 having beam form support straps 40 extending therebetween. The angle iron is placed over the top edge 41 of the beam side form walls 33 and 34, so that the beam form 32 is firmly supported at the top and bottom of the side walls 33 and 34 and firmly supported on the beam base by the wall frame 10.

As can be seen at this point, an advantage of the wall frames 10 and 11 is that they are put in place and act as part of the walls for the column and beam forms, while providing a support for the bracket for supporting the additional walls and then provides the necessary lateral support to prevent expansion of the forms from the hydrostatic pressure during the pour of the concrete.

In FIG. 6, the form in FIG. 1 has rebar 42 positioned therein and has a pair of temporary support legs 43 and 44 for supporting the wall frame in one direction until the column and beam have been poured. The wall frame 10 supports the pour in the direction of the wall.

Figure 5:
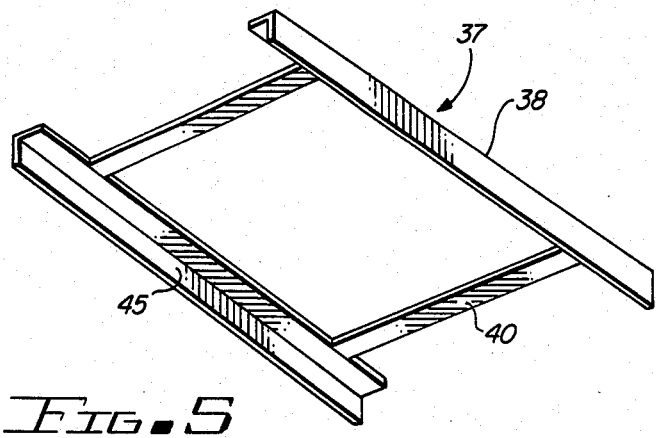
FIG. 5 is a perspective view of the beam form top support bracket.

FIG. 5 more clearly shows the top bracket 37 having a pair of angle irons 38 and a pair of support straps 40 extending therebetween forming an elongated flange 45 for supporting the top of the beam form walls 33 and 34.

Figure 7:
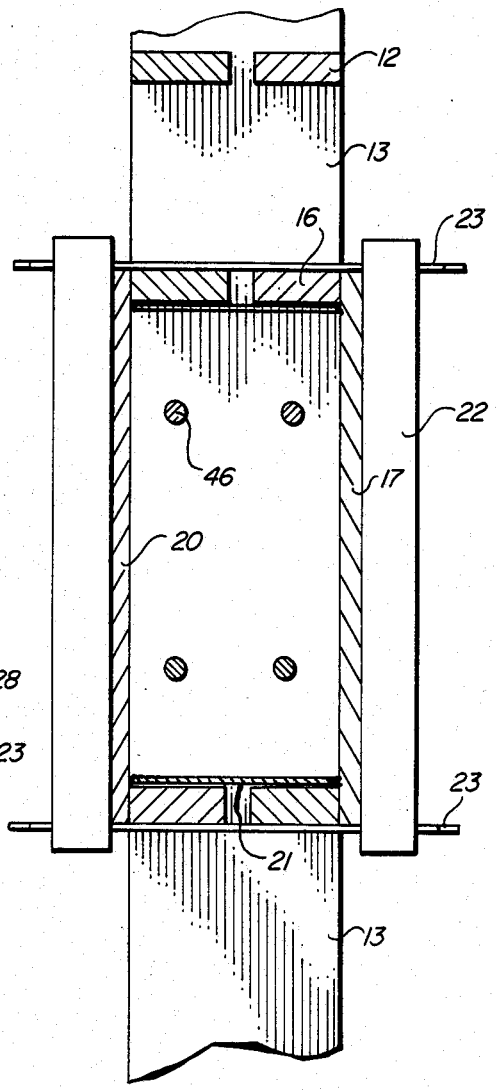
FIG. 7 is a top elevation of an alternate column form using the concrete form brackets of the present invention.

Turning to FIG. 7, a slightly modified form for a column 46 is illustrated having brackets 23 extending in both directions along a concrete form having a plurality of concrete form walls 47 supported on each side by a plurality of 2×4 ties 48 locked between the brackets 23. Thus, pairs of the brackets run on either side of the column 46 and are attached to the column form walls 47 for supporting the 2×4 sections on all four sides. This allows an independent column to be poured using the brackets of FIGS. 2 through 4 where the column is not being supported in the wall between wall sections 10.

It should be clear at this point that a structural wall and concrete form system has been shown which not only makes up portions of the column and beam walls but also supports the remaining walls of the forms. It should, however, be clear that the present invention is not to be considered as limited to the forms shown, which are to be considered illustrative rather than restrictive.

I claim:

1. A structural wall and concrete form system comprising in combination:

a wall frame having a plurality of upright spaced studs attached to a sole plate and to a header, one end of two wall frame sections forming a pair of concrete column form side walls, whereby said wall frame supports a concrete column during pouring of said column and said wall frame header forms the base of a concrete beam form, so that forms for columns and beams are partially formed and supported with wall frames; and a plurality of form brackets attached to said wall frame and aligned to support ties for locking a pair of additional column form walls for each column, thereby forming a complete column form.

2. A structural wall and concrete form system in accordance with claim 1, in which each form bracket extends transversely across a wall frame section and is attached thereto for supporting form ties on either side of said column form.

3. A structural wall and concrete form system in accordance with claim 2, in which a plurality of form brackets are attached to a top portion of said wall frame to support ties for locking a beam concrete form walls in position adjacent said wall frame headers.

4. A structural wall and concrete form system in accordance with claim 3, including a plurality of beam support brackets positioned onto the top edge of the side walls of said beam form walls.

5. A structural wall and concrete form system in accordance with claim 2, in which each said form bracket is an elongated flat metal bracket having a plurality of slot openings therethrough and a pair of upright form support portions on either end thereof for supporting a form locking tie thereagainst.

6. A structural wall and concrete form system in accordance with claim 5, in which each said bracket has marking notches therein and each upright form support portion has a sloped surface portion for guiding a form tie between said upright form support portion of said bracket and the form walls for locking the form walls in place.

7. A structural wall and concrete form system in accordance with claim 3, in which each said beam support bracket includes a pair of angle iron members connected with at least one strap therebetween for attaching one side of each angle iron member over the top edge of said beam form side walls to thereby prevent the top of said form walls from expanding during the pour of concrete into said beam form.

8. A structural wall and concrete form system in accordance with claim 1, in which said wall frame header is covered with a flat surface having an aluminum foil coating thereon for contact with said concrete during the pouring of said concrete into said form.

9. A structural wall and concrete form system in accordance with claim 8, in which said wall frame has those portions forming a portion of a column form lined with a panel material coated with aluminum foil.

* * * * *